US006247773B1

(12) United States Patent
Harigai et al.

(10) Patent No.: US 6,247,773 B1
(45) Date of Patent: Jun. 19, 2001

(54) COOLING STORAGE CABINET

(75) Inventors: Kazuo Harigai; Hiroshi Naganuma, both of Gunma-ken; Zenichi Kakinuma, Tochigi-ken; Daisaburo Kishimoto, Saitama-ken, all of (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 0 days.

(21) Appl. No.: 09/257,426

(22) Filed: Feb. 25, 1999

(30) Foreign Application Priority Data

Feb. 25, 1998 (JP) ..... 10-060652

(51) Int. Cl.[7] ..... A47B 96/04

(52) U.S. Cl. ..... 312/405; 312/139.2

(58) Field of Search ..... 312/116, 118, 312/138.1, 139.2, 401, 405, 296, 236, 234.1, 234.3, 400; 62/252, 440, 441, 442; D15/81, 83, 84, 85; 220/345.5; 49/33, 504

(56) References Cited

U.S. PATENT DOCUMENTS 1,382,704 * 6/1921 Wolf ..... 312/117
1,774,431 * 8/1930 Foreman ..... 62/252
2,192,519 * 3/1940 King ..... 312/139.2 X
2,198,436 * 4/1940 Hoffman ..... 312/139.2
2,276,635 * 3/1942 Weber ..... 312/296 X
2,446,601 * 8/1948 Lelyveld ..... 312/117
2,531,323 * 11/1950 Connell ..... 312/236 X
2,569,763 * 10/1951 Hofferberth ..... 312/296 X
2,608,181 * 8/1952 Schmidt et al. ..... 312/400 X
2,793,925 * 5/1957 Rosen ..... 312/139.2
4,449,761 * 5/1984 Davis et al. ..... 312/116 X

FOREIGN PATENT DOCUMENTS

2217776 * 8/1990 (JP) ..... 312/400

* cited by examiner

*Primary Examiner*—Peter M. Cuomo
*Assistant Examiner*—James O. Hansen
(74) *Attorney, Agent, or Firm*—Darby & Darby

(57) ABSTRACT

A cooling storage cabinet in which condensation is prevented from being produced under such conditions that the condensation occurs on the glazing of its doors. The cooling storage cabinet is formed of a heat insulating housing having an opening that is opened and closed by one or more slidable doors. Each of the doors is constructed of a heat insulating wall with the periphery portion of each of two opposing sides being thinner and a door sash into which each peripheral portion is fitted to slide on the cabinet adjacent the opening.

4 Claims, 13 Drawing Sheets

COOLING STORAGE CABINET

BACKGROUND OF THE INVENTION

The present invention relates to a cooling storage cabinet whose opening is openably closed by slidable doors.

Hitherto, in the kind of cooling storage cabinet, for example, as shown in Japanese Patent Application Publication Laid-open No. 3-27835, a storage chamber for receiving articles is constructed in a heat insulating housing whose upper surface is opened and the opening on the upper surface of the heat insulating housing is openably closed by slidable doors.

Each door is constructed in such a manner that one or double glazings is fitted into a door sash made of resin or aluminum. The sash is slidably arranged into rail portions formed on the edges of the opening of the heat insulating housing.

When the cooling storage cabinet is placed outside, air around the door glazing surface is cooled and condensation occurs due to a temperature difference between internal and external temperatures of the door glazing. Particularly, under conditions of high humidity in the summer season, there is a problem that the amount of condensation increases and it results in soil around the cooling storage cabinet.

In order to solve the above problem, when the opening is closed by a heat insulating material having good heat insulating properties, a problem sometimes occurs in that the opening cannot be opened or closed due to a difference in dimension.

SUMMARY OF THE INVENTION

The invention is made in order to solve the conventional technical problems and intends to provide a cooling storage cabinet which can easily and certainly prevent condensation in the glazing of doors from generating under such installing conditions that the condensation easily occurs.

The cooling storage cabinet according to the invention is constructed in such a manner that an opening of a heat insulating housing is opened and closed by slidable doors and each door is constructed by a heat insulating wall formed so that the dimension in thickness of a peripheral portion is thinned and a door sash is fitted into the peripheral portion of the heat insulating wall.

The cooling storage of the invention has a plurality of doors arranged inside and outside in a double sliding manner in the above construction. The heat insulating wall of the door located outside is outwardly expanded from the peripheral portion. The heat insulating wall of the door located inside is inwardly expanded from the peripheral portion.

Further, in accordance with the invention, the cooling storage of the invention has holding portions for holding advertising members on the external surfaces of the heat insulating walls of the doors.

DETAILED DESCRIPTION OF THE PREFERRED EMBODIMENTS

Figure 1:
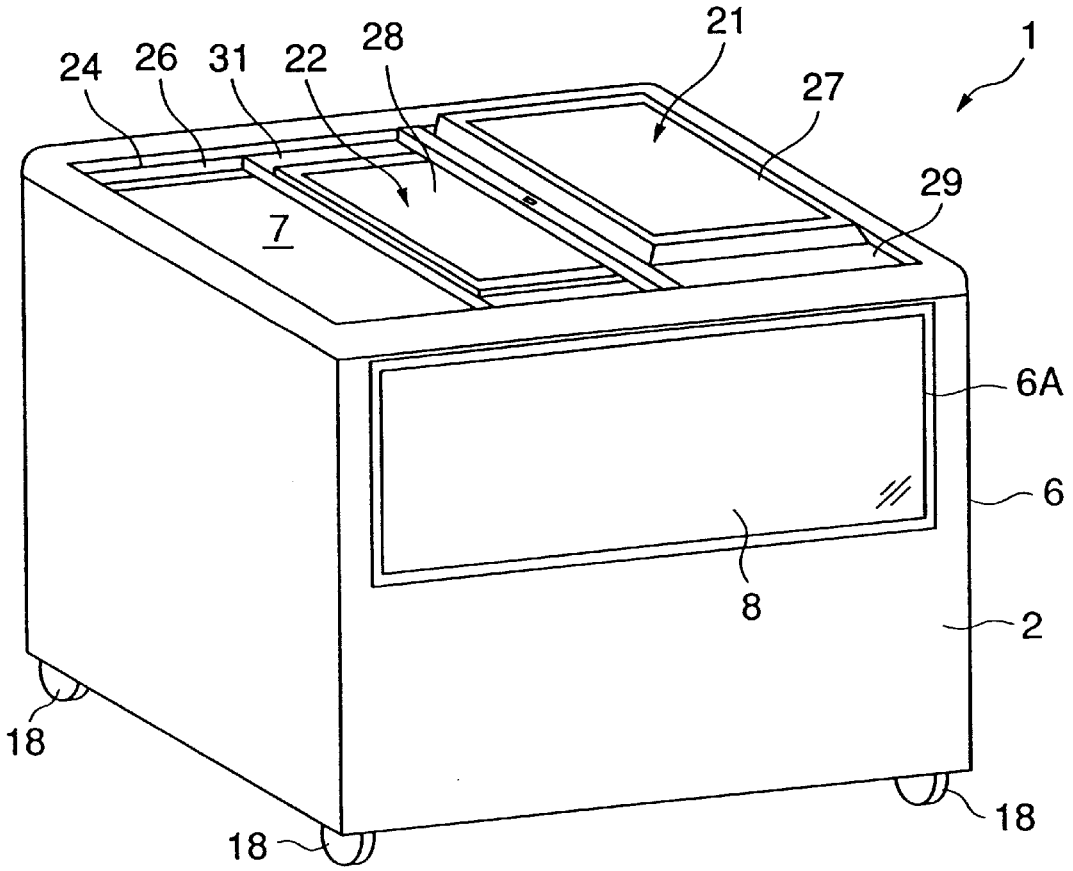
FIG. 1 is a perspective view of a cooling storage cabinet of the invention.

Embodiments of the invention will now be described in detail hereinbelow with reference to the drawings.

A cooling storage cabinet 1 of the embodiment stores frozen articles such as ice-cream therein and is used to sell the articles. Its main body is constructed by a heat insulating housing 6 comprising: an external box 3 and an internal box 3 each of whose upper surface is opened; and a polyurethane heat insulating material 4 which is foamed and filled between those boxes 2, 3. A storage chamber 7 whose upper surface is opened is constructed in the heat insulating housing 6 and a window hole 6A is formed on the upper portion of the front wall of the heat insulating housing 6.

A double glazing 8 is fitted into the window hole 6A so as to enable to see through the storage chamber 7. A bottom sheet 9 having a luggage rack form is laid in a portion of the storage chamber 7 located on the side that is slightly lower than the lower edge of the window hole 6A. A cooler 11 and a blower 12 of a cooling device are installed below the bottom sheet. The front and rear edges of the bottom sheet 9 are arranged at a distance from the front and rear walls in the heat insulating housing 6. A cold air discharging outlet 13 and a cold air sucking inlet 14 are formed in the distances, respectively.

Figure 2:
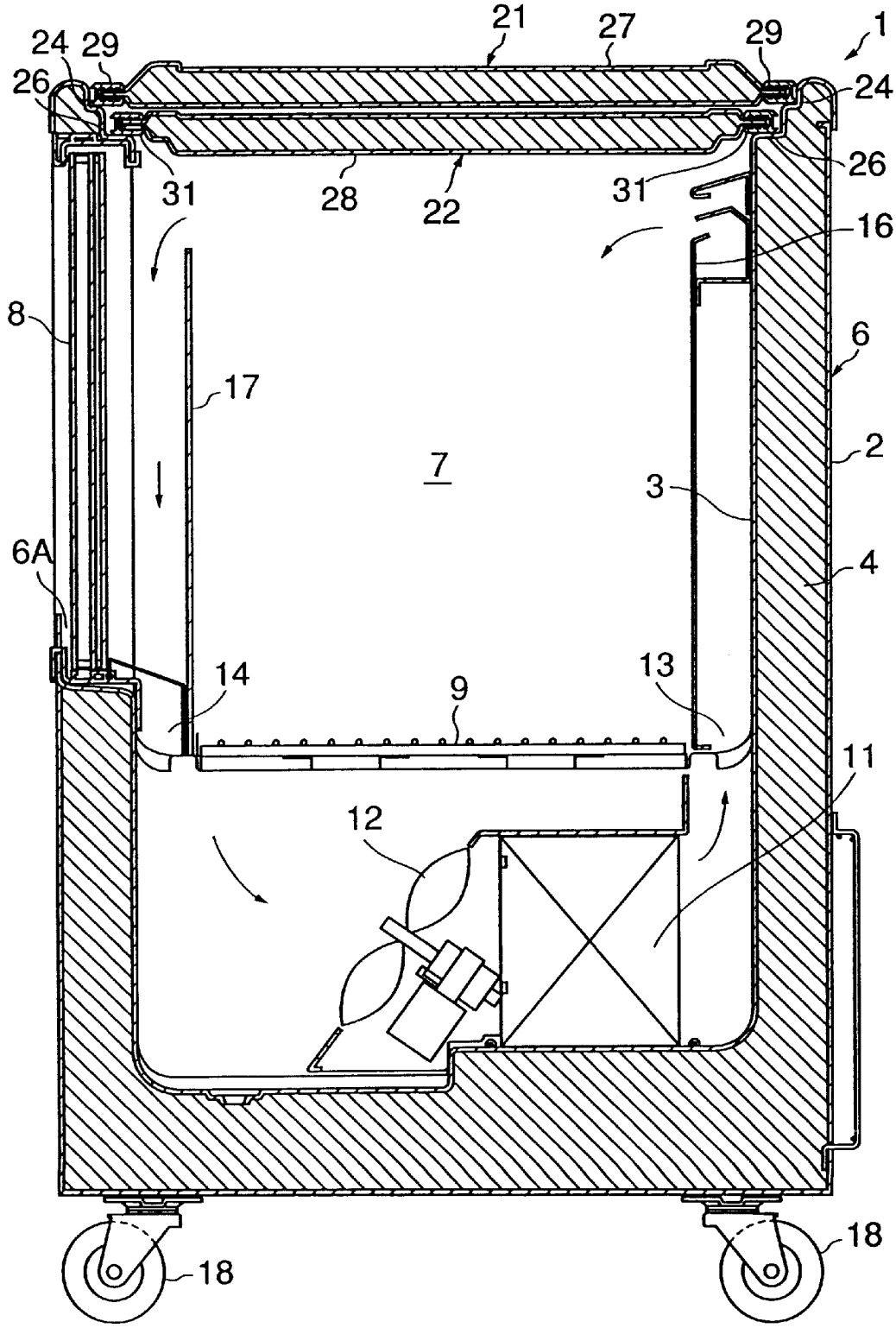
FIG. 2 is a vertically sectional side view of the cooling storage cabinet of the invention.
Figure 3:
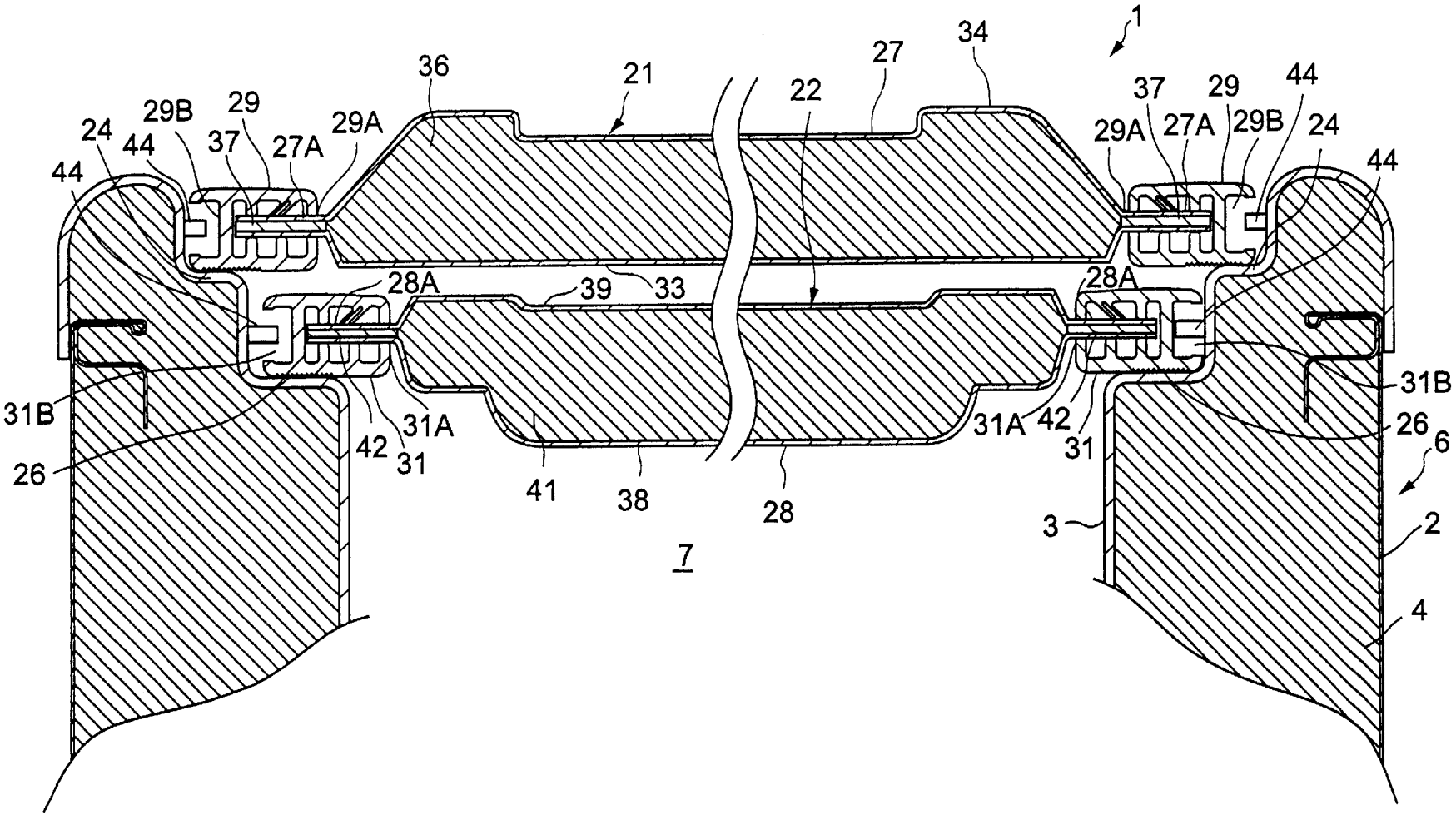
FIG. 3 is an enlarged vertically sectional side view of the upper portion of the cooling storage cabinet of FIG. 2.
Figure 4:
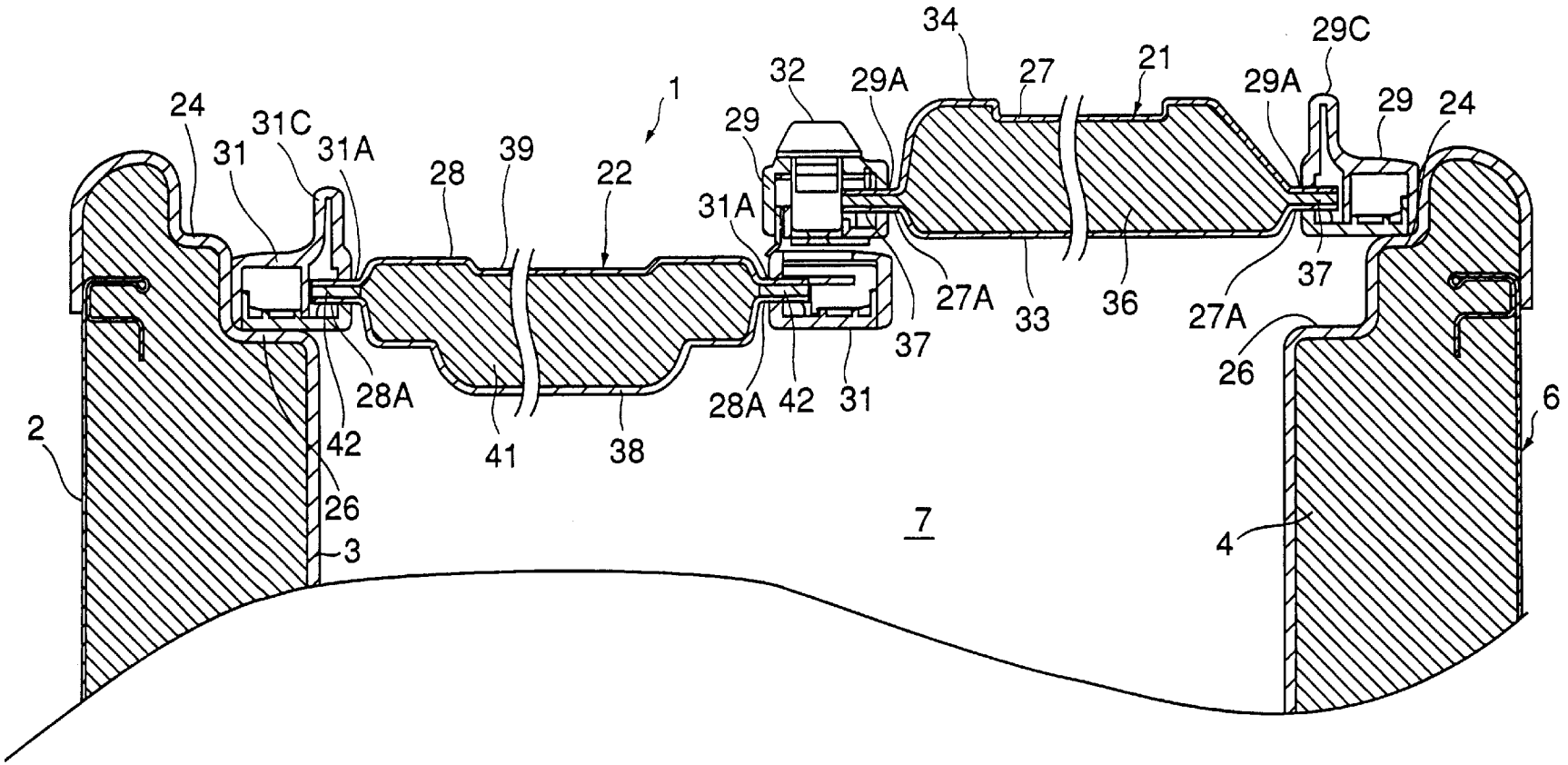
FIG. 4 is an enlarged vertically sectional front view of the upper portion of the cooling storage cabinet of FIG. 2.

A duct plate 17 which extends upward at a distance from the rear wall of the heat insulating housing 6 is attached to the cold air discharging outlet 13. A transparent glass board 17 which extends upward at a distance from the front wall of the heat insulating housing 6 and glazing 8 is attached to the cold air sucking inlet 14. In the above construction, when the blower 12 is driven, cold air cooled by the cooler 11 is discharged from the cold air discharging outlet 13, allowed to rise between the duct plate 16 and heat insulating housing 6, and then discharged from the upper edge into the storage chamber 7. The cold air cycled in the storage chamber 7 falls from the upper edge of the glass board 17 through a portion between the glass board 17 and glazing 8 and is sucked into the blower 12 (shown by arrows in FIG. 2). Consequently, the inside of the storage chamber 7 is cooled at a predetermined freezing temperature. Reference numerals 18 denote universal wheels attached to four corners of the bottom surface of the heat insulating housing 6.

Two doors 21 and 22 of a right/left double sliding type are attached to the opening on the upper surface of the storage chamber 7 (heat insulating housing 6), thereby openably closing the storage chamber 7. In this case, two upper and lower rails 24, 26 are formed on the right and left sides of the internal box 3 located on the front and rear edges of the opening of the heat insulating housing 6. The doors 21, 22 are slidably attached to the rails 24, 26, respectively.

The doors 21, 22 are constructed by heat insulating walls 27, 28 and door sashes 29, 31, respectively. In this case, the door sashes 29, 31 are door sashes for a normal glazing door and are formed in a frame shape by rigid synthetic resin or aluminum. Engaging grooves 29A, 31A which are opened inwardly are formed around the door sashes 29, 31. Concave portions 29B, 31B are formed on the upper and lower external surfaces of the door sashes, respectively.

In this case, the engaging grooves 29A, 31A are grooves for engaging normal glazing (for example, double glazing), respectively. Knobs 29C, 31C protrude from on the upper surfaces on the right side of the door sash 29 and the left side of the door sash 31, respectively. A lock 32 is attached to the left side of the door sash 29 so as to lock on the right side of the door sash 31.

The heat insulating wall 27 comprises: internal and external face members 33, 34 each of which is constructed by a vacuum forming mold made of synthetic resin; and a heat insulating material 36 which is foamed and filled between the internal and external face members 33 and 34. In this case, the internal and external face members 33, 34 located on the periphery of the heat insulating wall 27 are arranged so as to be close to each other, thereby forming thin portions 27A in each of which a cushioning material 37 is merely sandwiched and whose dimension in thickness is thin. The thickness of thin portion 27A is equivalent to the dimension in thickness of the normal glazing (for example, double glazing). The heat insulating wall 27 is formed so that the inner portion from the thin portions 27A is outwardly (upwardly) expanded, so that a predetermined heat insulating thickness Is maintained.

Each of the thin portion 27A of the heat insulating wall 27 Is fitted Into each of the engaging grooves 29A, thereby finishing the door 21. In this instance, the internal face member 33 is located so as to be substantially coincident with the lower surface of the door sash 29.

On the other hand, the heat Insulating wall 28 comprises: internal and external face members 38, 39 each of which is constructed by a vacuum forming mold made of synthetic resin; and a heat insulating material 41 foamed and filled between the internal and external face members 38, 39. In this case, the internal and external face members 38, 39 located on the periphery of the heat insulating wall 28 are arranged so as to be close to each other, thereby forming thin portions 28A in each of which a cushioning material 42 is merely sandwiched and whose dimension in thickness is thin. The thickness of each of the thin portions 28A is also constructed so as to be substantially coincident with the dimension in thickness of the normal glazing (for example, double glazing). The heat insulating wall 28 is shaped into a form in which the inner portion from the thin portions 28A is inwardly (downwardly) expanded, thereby maintaining a predetermined heat insulating thickness.

The thin portions 28A of the heat insulating wall 28 are fitted into the engaging grooves 31A of the door sash 31, thereby finishing the door 22. In this instance, the external face member 39 is located on the position which is substantially coincident with that of the upper surface of the door sash 31.

The door 22 constructed in this manner is attached by slidably setting the door sash 31 to the rails 26 on the lower side of the heat insulating housing 6. The door 21 is attached by slidably setting the door sash 29 to the rails 24 on the upper side. Protrusions 44, 44 are formed on the positions corresponding to the front and rear of the rails 24, 26 in the internal-box 3. Those protrusions 44, 44 enters the concave portions 29B, 31B of the door sashes 29, 31. Consequently, the doors 21, 22 are not detached when the lock 32 is locked up.

In this case, since the door sashes 29, 31 are the door sashes for the normal glazing door, they can be easily attached to the rails 24, 26 of the existing heat insulating housing 6 in place of the normal glazing doors. Therefore, when the cooling storage cabinet 1 is placed under such conditions that the condensation occurs on the door glazing, for example, outside, the condensation on the upper surfaces of the doors 21, 22 can be effectively prevented by the heat insulating walls 27, 28.

Since the heat insulating wall 27 of the door 21 on the upper side is outwardly (upwardly) expanded from the thin portions 27A on the periphery and the heat insulating wall 28 of the door 22 on the lower side is inwardly (downwardly) expanded from the thin portions 28A of the periphery, there is no case where the heat insulating walls 27, 28 of the upper and lower doors 21, 22 hit on each other upon opening or closing.

Consequently, while the opening/closing properties of the double sliding doors 21, 22 are favorably maintained, the heat insulating properties of the heat insulating walls 27, 28 can be improved.

Figure 5:
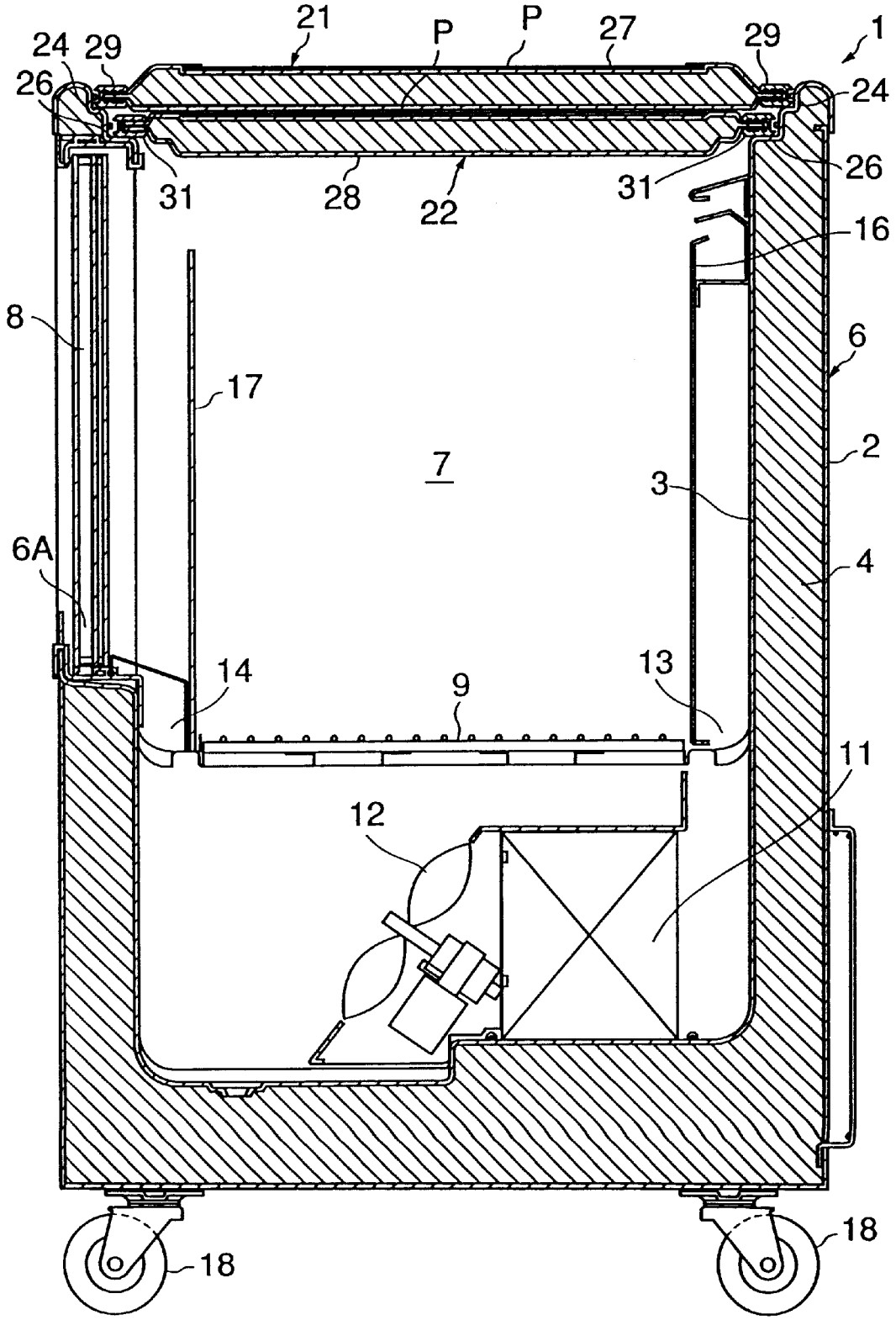
FIG. 5 is a vertically sectional side view of a cooling storage cabinet of another embodiment of the invention.
Figure 6:
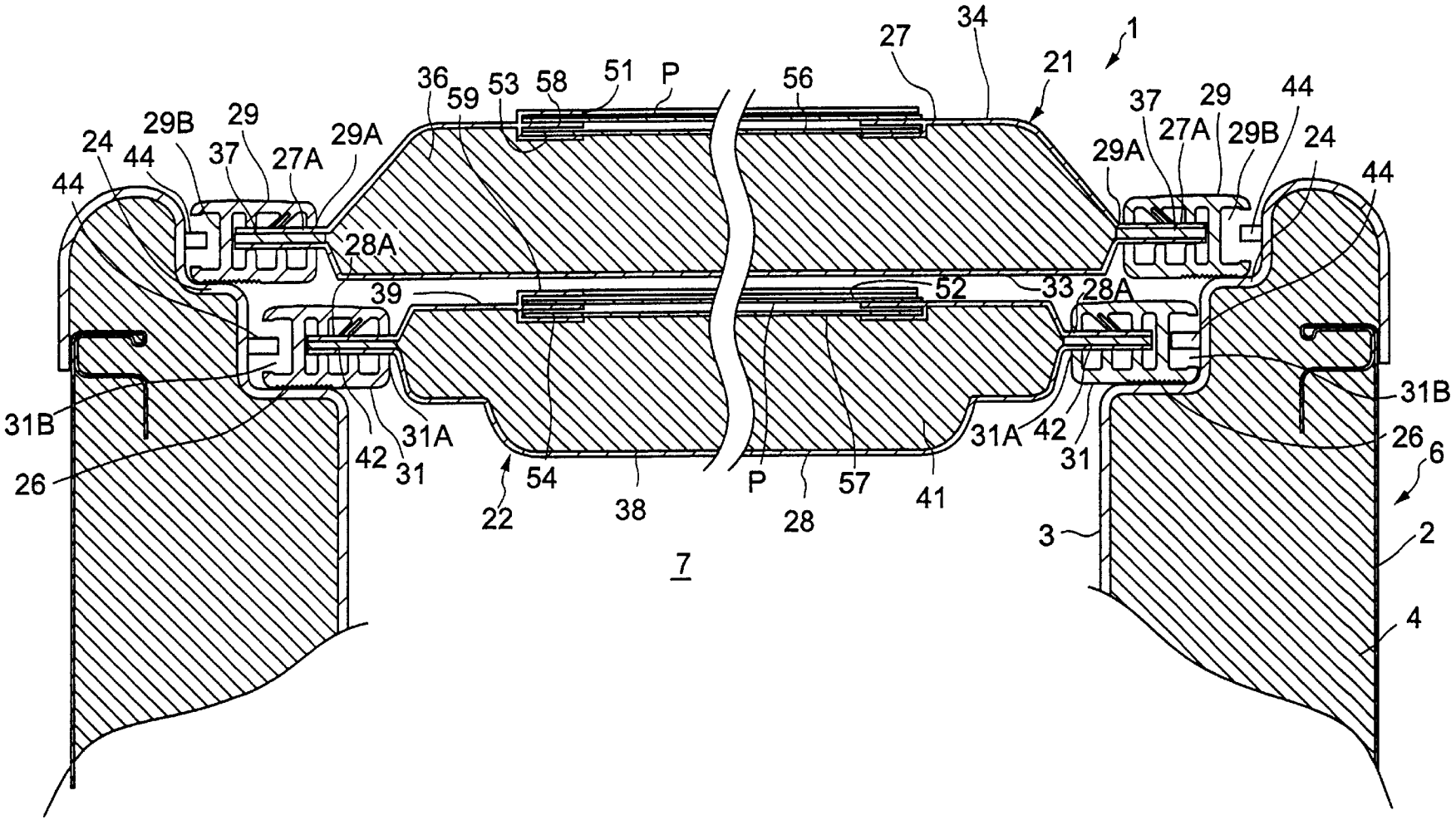
FIG. 6 is an enlarged vertically sectional side view of the upper portion of the cooling storage cabinet of FIG. 5.
Figure 7:
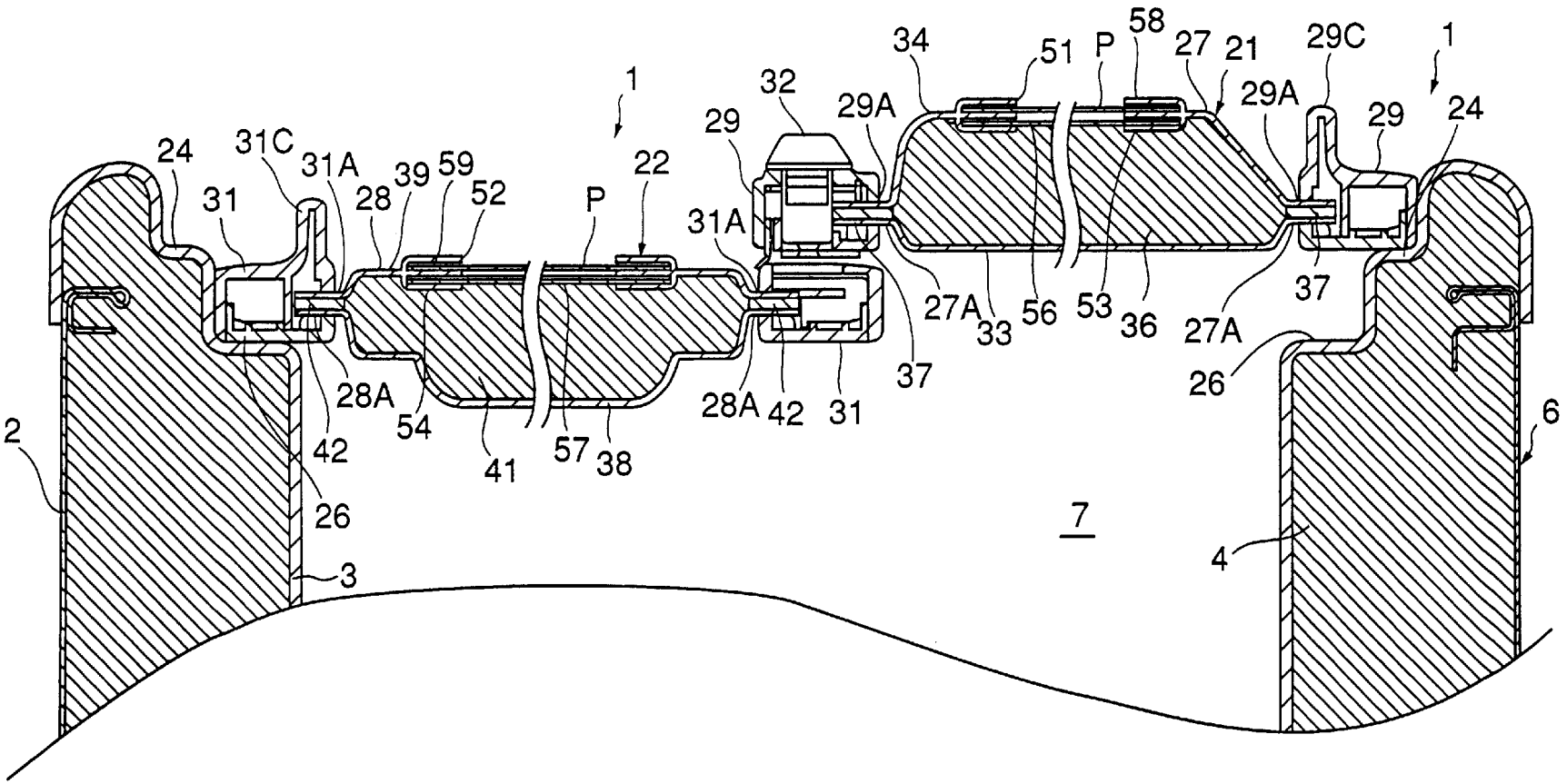
FIG. 7 is an enlarged vertically sectional front view of the upper portion of the cooling storage cabinet of FIG. 5.

FIGS. 5 to 7 show a cooling storage cabinet 1 of another embodiment of the invention. In this case, the external face members 34, 39 of the heat insulating walls 27, 28 of the doors 21 and 22 are constructed by extrusion molding using rigid synthetic resin. Openings 51, 52 are formed on the center portions of the doors. Engaging grooves 53, 54 are formed on the lower peripheral portions of the openings 51, 52. Heat insulating sheets 56, 57 are fitted into the engaging grooves 53, 54.

Holding grooves 58, 59 are formed as holding portions on the right and left edges on the upper sides and front edge sides of the openings 51, 52. Sheet-shaped advertising members P on each of which an advertisement of articles is printed are inserted from the back sides into the holding grooves 58, 59 and are held. The other structures are the same as those in FIGS. 1 to 4.

By the above structure, an advertising function can be easily added to the doors 21, 22, so that a sales promotion effect for articles (ice-cream or the like) received in the storage chamber 7 can be improved.

Figure 8:
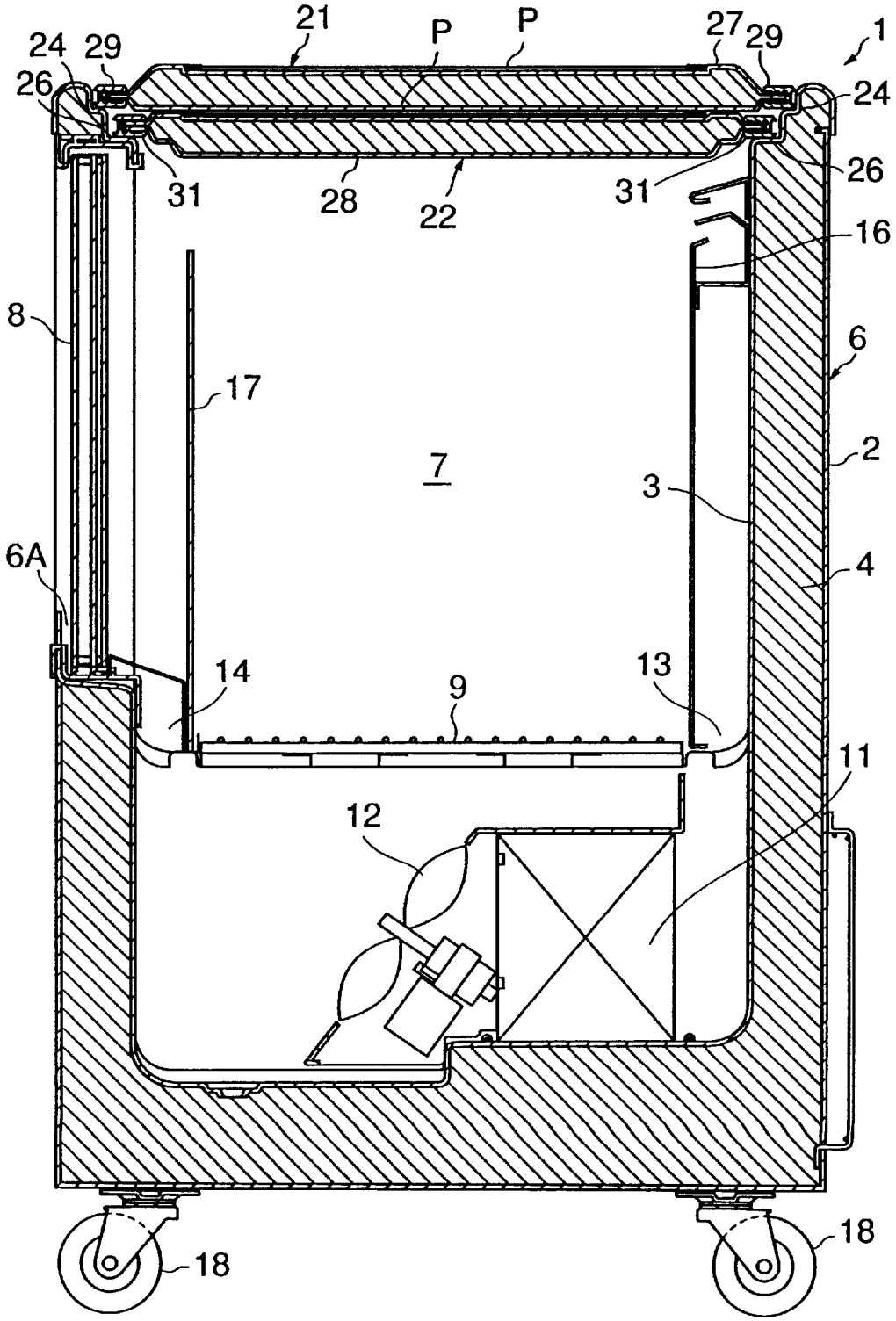
FIG. 8 is a vertically sectional side view of a cooling storage cabinet of still another embodiment of the invention.
Figure 9:
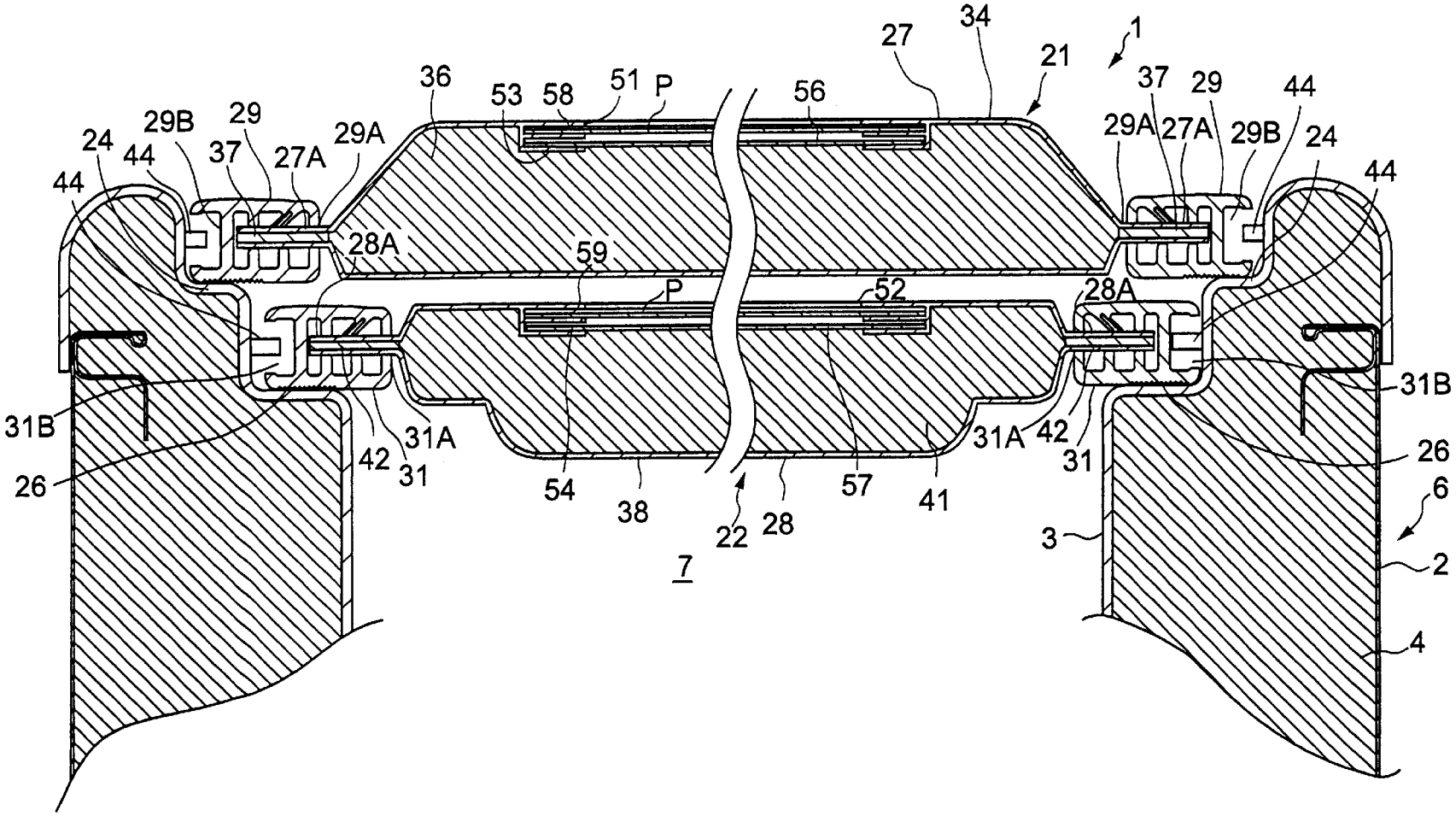
FIG. 9 is an enlarged vertically sectional side view of the upper portion of the cooling storage cabinet of FIG. 8.
Figure 10:
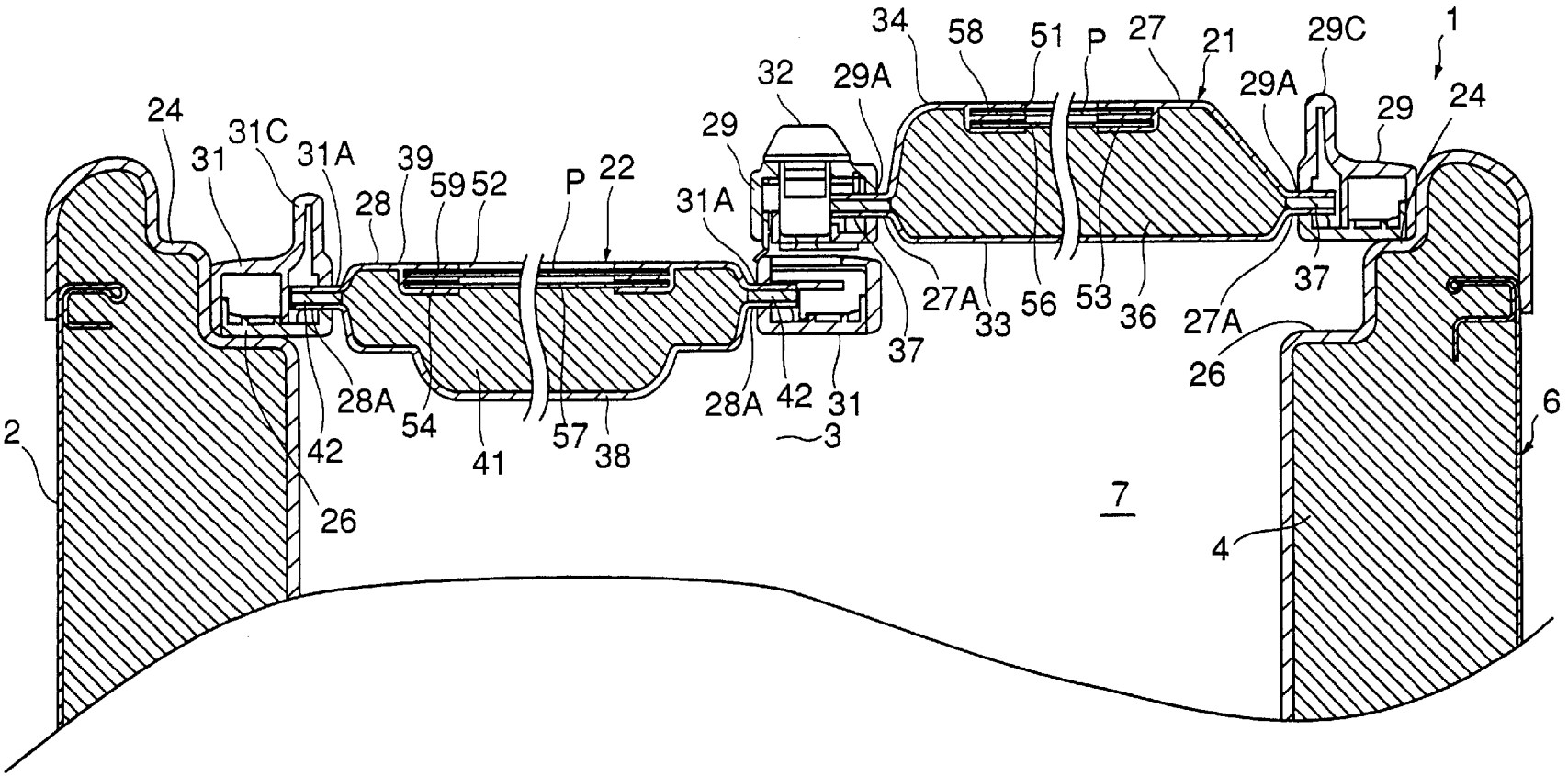
FIG. 10 is an enlarged vertically sectional front view of the upper portion of the cooling storage cabinet of FIG. 8.

FIGS. 8 to 10 show a cooling storage cabinet 1 of further another embodiment of the invention. In this case, the holding grooves 58, 59 are formed on the lower peripheral portions of the openings 51, 52 of the external face members 34, 39 of the heat insulating walls 27, 28 of the doors 21 and 22. The engaging grooves 53, 54 are formed under the holding grooves, and the advertising members P are fitted into the holding grooves 58, 59 so as to cover the upper surfaces of the grooves. In the above structure as well, the advertising function can be extremely easily added to the doors 21, 22, so that the sales promotion effect for the articles (ice-cream or the like) received in the storage chamber 7 can be improved.

Figure 11:
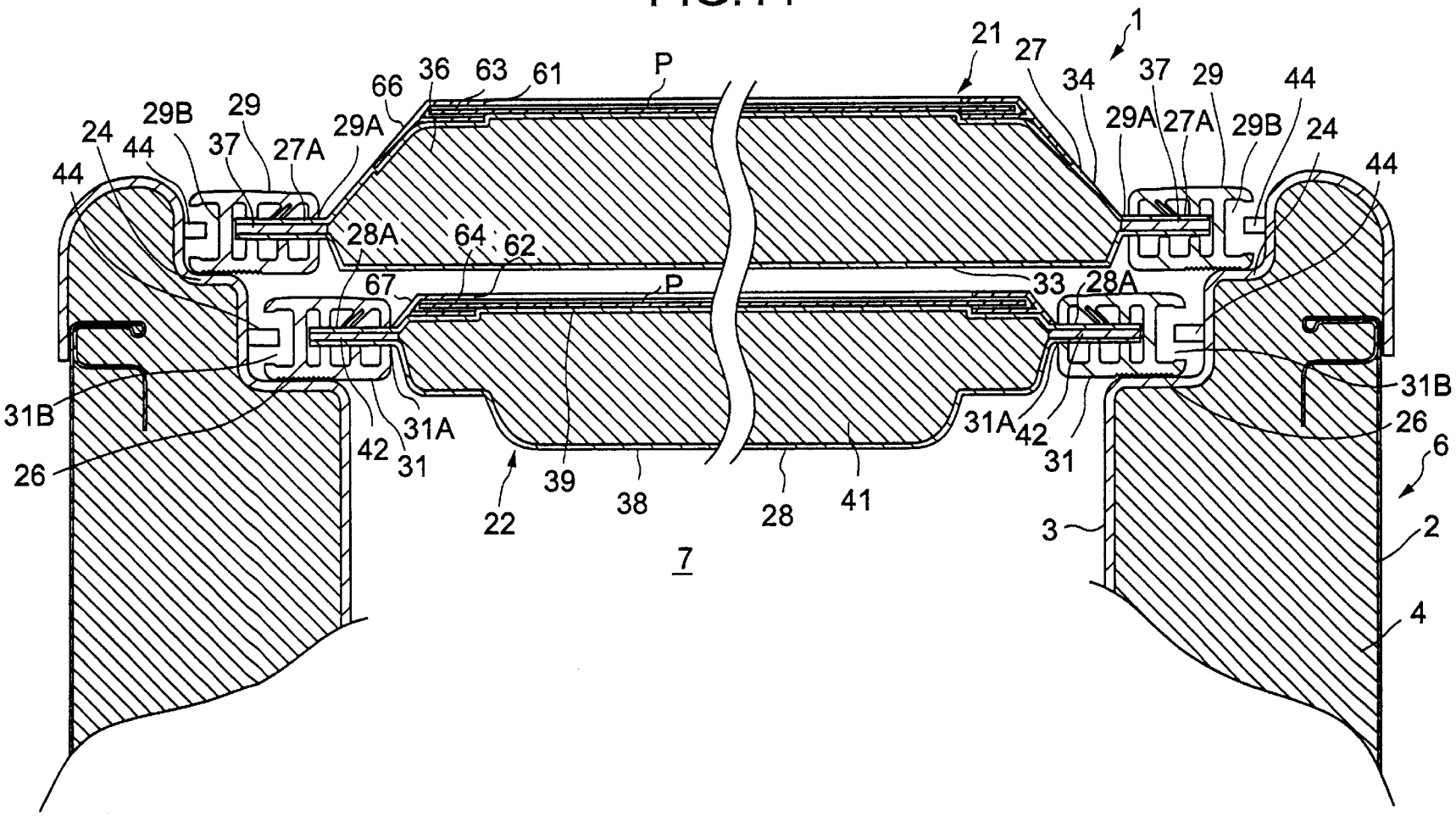
FIG. 11 is an enlarged vertically sectional side view of the upper portion of a cooling storage cabinet of further another embodiment of the invention.
Figure 12:
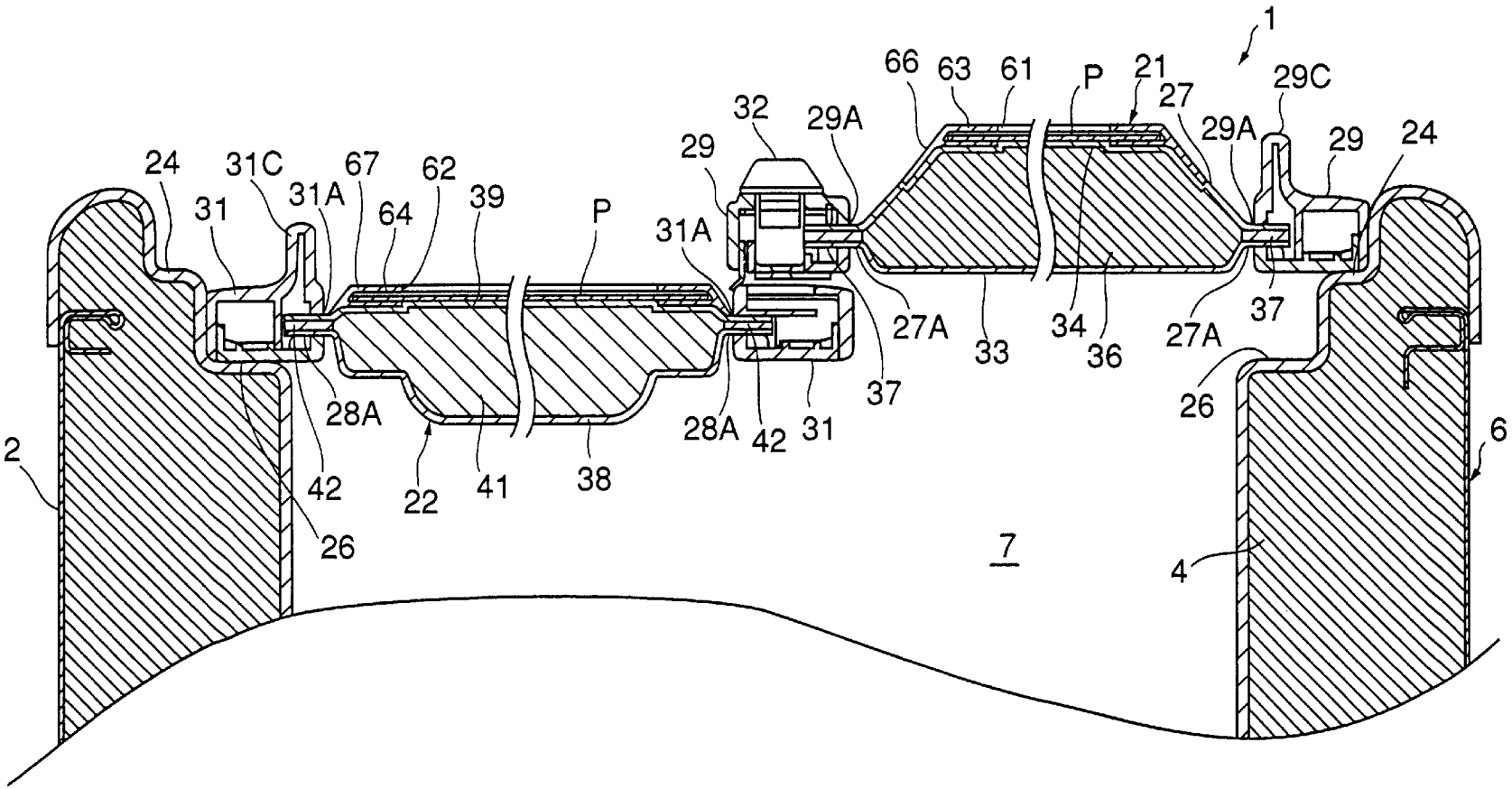
FIG. 12 is an enlarged vertically sectional front view of the upper portion of the cooling storage cabinet of FIG. 11.

FIGS. 11 and 12 show a cooling storage cabinet 1 of still another embodiment of the invention. In this case, holding members 66, 67 in which holding grooves 63, 64 are formed on the peripheral portion of openings 61, 62 and which are made of rigid synthetic resin and are constructed by protrusion molding are adhered onto the upper surfaces of the external face members 34, 39 of the heat insulating walls 27, 28 of the doors 21 and 22, thereby forming the holding portions. The advertising members P are fitted into the holding grooves 63, 64 so as to cover the upper surfaces of the grooves. By the above structure as well, the advertising function can be remarkably easily added to the doors 21, 22, so that the sales promotion effect for articles (ice-cream or the like) received in the storage chamber 7 can be improved.

Figure 13:
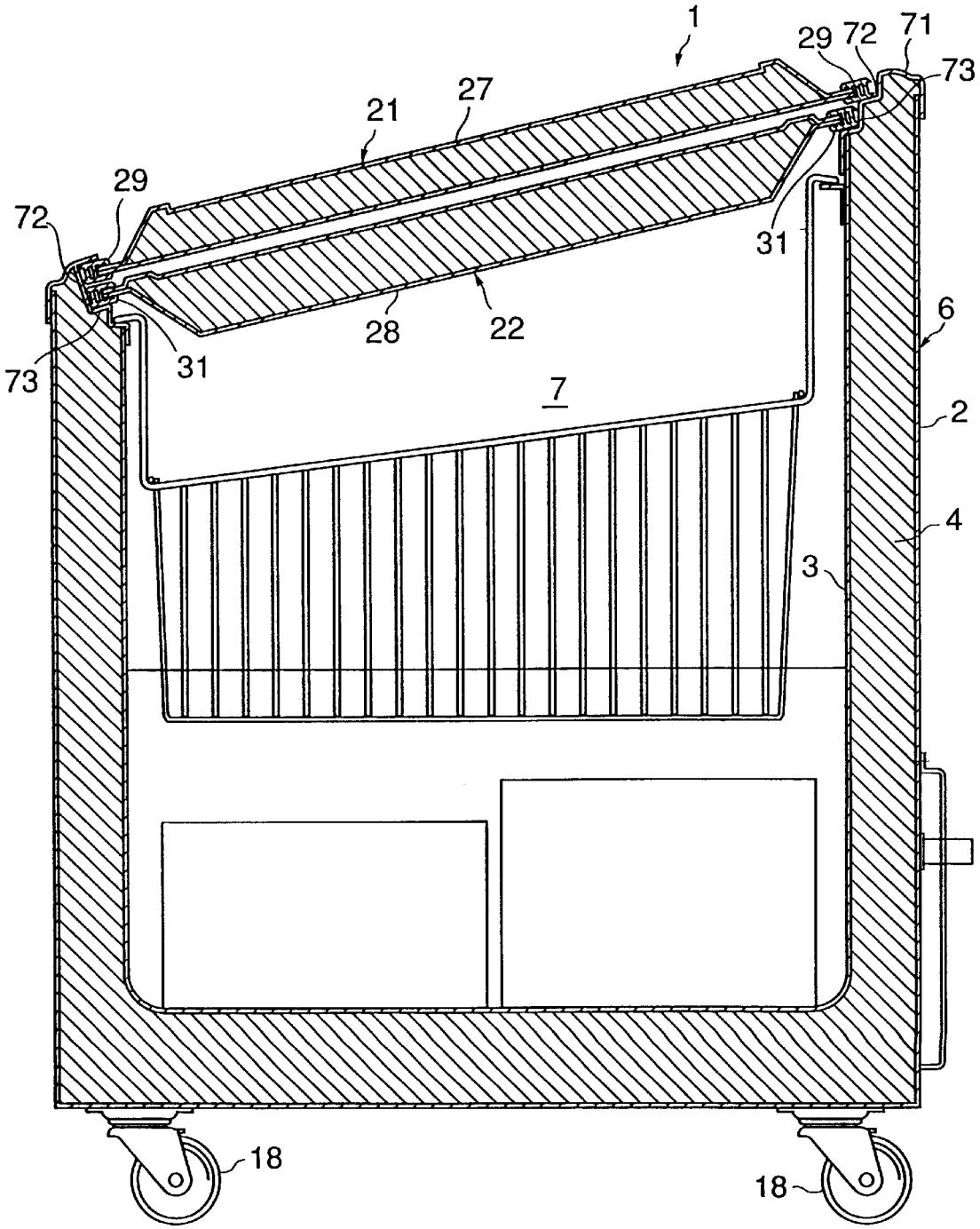
FIG. 13 is a vertically sectional side view of a cooling storage cabinet of further another embodiment of the invention.

FIG. 13 shows a cooling storage cabinet 1 of further another embodiment of the invention. In this case, the upper edges of the internal box 3 and external box 3 are coupled by breakers 71 made of resin. The opening of the upper surface of the heat insulating housing 6 is formed so as to be inclined in such a manner that the front side is low and the back side is high. The doors 21, 22 are set onto the upper and lower rails 72, 73 formed on the breakers 71.

By the structure, it is easy to take the article out of the storage chamber 7.

As described in detail, according to the invention, in the cooling storage cabinet constructed in such a manner that the opening of the heat insulating housing is opened and closed by slidably doors, since each door is constructed by the heat insulating wall formed so that the dimension in thickness of the peripheral portion is thin and the door sash into which the peripheral portion of the heat insulating wall is fitted, even when the cooling storage cabinet is placed under such conditions that the condensation occurs on the glazing door, for example, outside, the condensation onto the external surface of the door can be effectively prevented by the heat insulating walls.

Particularly, since the dimension in thickness of the peripheral portion of the heat insulating wall is thinned and the peripheral portions are fitted into the door sash, it can be handled in a manner similar to the normal glazing door. That is, the door of the invention can be extremely easily attached to the existing heat insulating housing in place of the glazing door and is remarkably excellent in convenience.

According to the invention, in addition to the above, when a plurality of doors are arranged inside and outside in a double sliding manner, the heat insulating wall of the door on the outside is outwardly expanded from the peripheral portion and the heat insulating wall of the door on the inside is inwardly expanded from the peripheral portion, so that there is no case where the heat insulating walls of the internal and external doors hit on each other upon opening/closing.

Consequently, while the opening/closing operational properties of the double sliding type doors are favorably maintained, the heat insulating properties of the heat insulating wall can be improved.

Further, according to the invention, in addition to each invention, since the holding portions for holding the advertising members are arranged on the external surfaces of the heat insulating walls of the doors, the advertising function can be extremely easily added to the doors, so that the sales promotion effect for the stored articles can be improved.

What is claimed is:

1. A cooling storage cabinet cabinet comprising:

a heat insulating housing having an opening which is opened and closed by a plurality of slidable doors arranged in a double sliding manner over one another in said opening, wherein each said door is formed of a wall of a heat insulating material with a peripheral portion of each of two opposing sides being of reduced thickness relative to a more central part of said wall and wherein the heat insulating wall of one door is expanded in one direction from its peripheral portions toward the interior of said housing and the heat insulating wall of the other door is expanded in another direction opposite to said one direction from its peripheral portions; and a door sash about the peripheral portions of each door for sliding on said housing adjacent said opening to which said peripheral portions are fitted.

2. The cooling storage cabinet cabinet according to claim 1, further comprising holding portions for holding advertising members on the external surface of said heat insulating wall of a said door.

3. The cooling storage cabinet cabinet according to claim 1, further comprising holding portions for holding advertising members on the external surface of said heat insulating wall of each said door.

4. The cooling storage cabinet cabinet according to claim 1 wherein said heat insulating material is of plastic.

* * * * *

UNITED STATES PATENT AND TRADEMARK OFFICE

CERTIFICATE OF CORRECTION

PATENT NO. : 6,247,773 B1
DATED : June 19, 2001
INVENTOR(S) : Kazuo Harigai et al.

It is certified that error appears in the above-identified patent and that said Letters Patent is hereby corrected as shown below:

Title page,
Item [73] Assignee, change "Moriguchi (JP)" to -- Moriguchi-Shi, Osaka, (JP) --.

Signed and Sealed this

Fifth Day of February, 2002

*Attest:*

*Attesting Officer*

JAMES E. ROGAN
*Director of the United States Patent and Trademark Office*